US005522186A

United States Patent [19]

Jarman

[11] Patent Number: 5,522,186

[45] Date of Patent: Jun. 4, 1996

[54] TREE SUPPORTED STRUCTURE

[76] Inventor: Philip Jarman, 5840 Compton Road West, Port Alberni, British Columbia, Canada, V9Y 7V2

[21] Appl. No.: 257,154

[22] Filed: Jun. 9, 1994

[51] Int. Cl.[6] ..... E04B 1/34; E04H 1/12

[52] U.S. Cl. ..... 52/73; 52/82; 52/236.2; 182/187; 248/219.1

[58] Field of Search ..... 248/218.4, 219.1; 52/40, 82, 169.2, 236.2, 73, 79.4, 253, 260; 182/187, 188; 472/136; D25/3, 31, 32

[56] References Cited

U.S. PATENT DOCUMENTS

| | | | |
|---|---|---|---|
| 1,236,960 | 8/1917 | McMillan | 248/219.1 |
| 1,251,703 | 1/1918 | Spencer | 248/219.1 |
| 1,278,954 | 9/1918 | Looney | 182/187 |
| 1,515,831 | 11/1924 | Bush | 182/188 |
| 3,727,355 | 4/1973 | Vachon . | |
| 3,889,698 | 6/1975 | Roessl . | |
| 4,056,902 | 11/1977 | Ziegler, Jr. . | |
| 4,192,107 | 3/1980 | Wickstrom et al. . | |
| 4,225,013 | 9/1980 | Sample | 182/187 |
| 4,331,216 | 5/1982 | Amacker | 182/187 |
| 4,552,246 | 11/1985 | Thomas . | |

*Primary Examiner*—Michael Safavi
*Attorney, Agent, or Firm*—Norman M. Cameron

[57] ABSTRACT

A tree structure includes three vertically spaced-apart annular members extending about the trunk of a tree. Each annular member has a plurality of pointed members extending downwardly and inwardly into the trunk. The first annular member is below the second annular member and above the third annular member. The first and third annular members have joist supports and the second annular member has cable anchors. Joists extend radially outwards from the joist supports. Outer members are connected perpendicularly to the joists to form first and second outer rings extending about the first and third annular members. There are two platforms mounted on the joists. First cables are connected between the second annular member and the first ring. Second cables are connected between the first ring and the second ring. A roof extends over the first cables. Outer walls extend between the outer rings.

14 Claims, 5 Drawing Sheets

TREE SUPPORTED STRUCTURE

BACKGROUND OF THE INVENTION

This invention relates to tree supported structures and in particular to dwellings fitted about trunks of trees.

Tree houses are often considered to be restricted to use as play areas for children. However they actually have considerable potential as dwellings, particularly for recreational use. Such dwellings can be constructed without any significant harm to the environment as would occur with conventional dwellings built on the ground. These normally necessitate clearing trees. Building dwellings in trees allows the character of a forested area to remain, while permitting human habitation.

There have been earlier attempts to provide easy to construct tree houses or the like. An example is the tree house kit disclosed in U.S. Pat. No. 4,056,902 to Ziegler, Jr.

One factor that has limited widespread usage of tree dwellings is the difficulty in providing means for easily and securely mounting such structures to a tree so that they can bear substantial loads and yet can be mounted in different size trees.

Another problem is that some earlier mounting systems cannot accommodate tree growth without replacement or adjustment.

SUMMARY OF THE INVENTION

It is object of the invention to provide an improved tree supported structure which can be prefabricated and yet easily installed on tree trunks having different diameters within a specified range.

It is another object of the invention to provide an improved tree supported structure which can remain securely in place without need of adjustment, while allowing normal tree growth.

It is also an object of the invention to provide an improved tree supported structure which can safely bear substantial loads for protracted periods of time.

As a further object of the invention to provide an improved tree supported structure which is economical and is rugged in construction.

It is a still further object of the invention to provide an improved tree supported structure which can be erected quickly and with minimum on-site construction and labor.

In accordance with these objects, there is provided a tree supported structure which includes a first annular member having a plurality of inwardly pointed members. There are outwardly extending first supports and a first platform connected to the supports.

Preferably the annular member has a top and a bottom. The pointed members are angled downwardly and extend below the bottom of the annular member when positioned for use.

The structure may have a second annular member with a plurality of inwardly pointed members above the first annular member. A plurality of first tension members have top ends connected to the second annular member and bottom ends connected to the first platform.

The structure may also have a third annular member below the first annular member with a plurality of inwardly pointed members. The third annular member has outwardly directed second supports and a second platform is connected to the second supports. There may be a plurality of second tension members having tops connected to the first platform and bottoms connected to the second platform The structure may have a roof extending over the first tension members between the second annular member and the first platform. There may also be walls extending between the first and second platforms.

DESCRIPTION OF THE PREFERRED EMBODIMENTS

Figure 1:
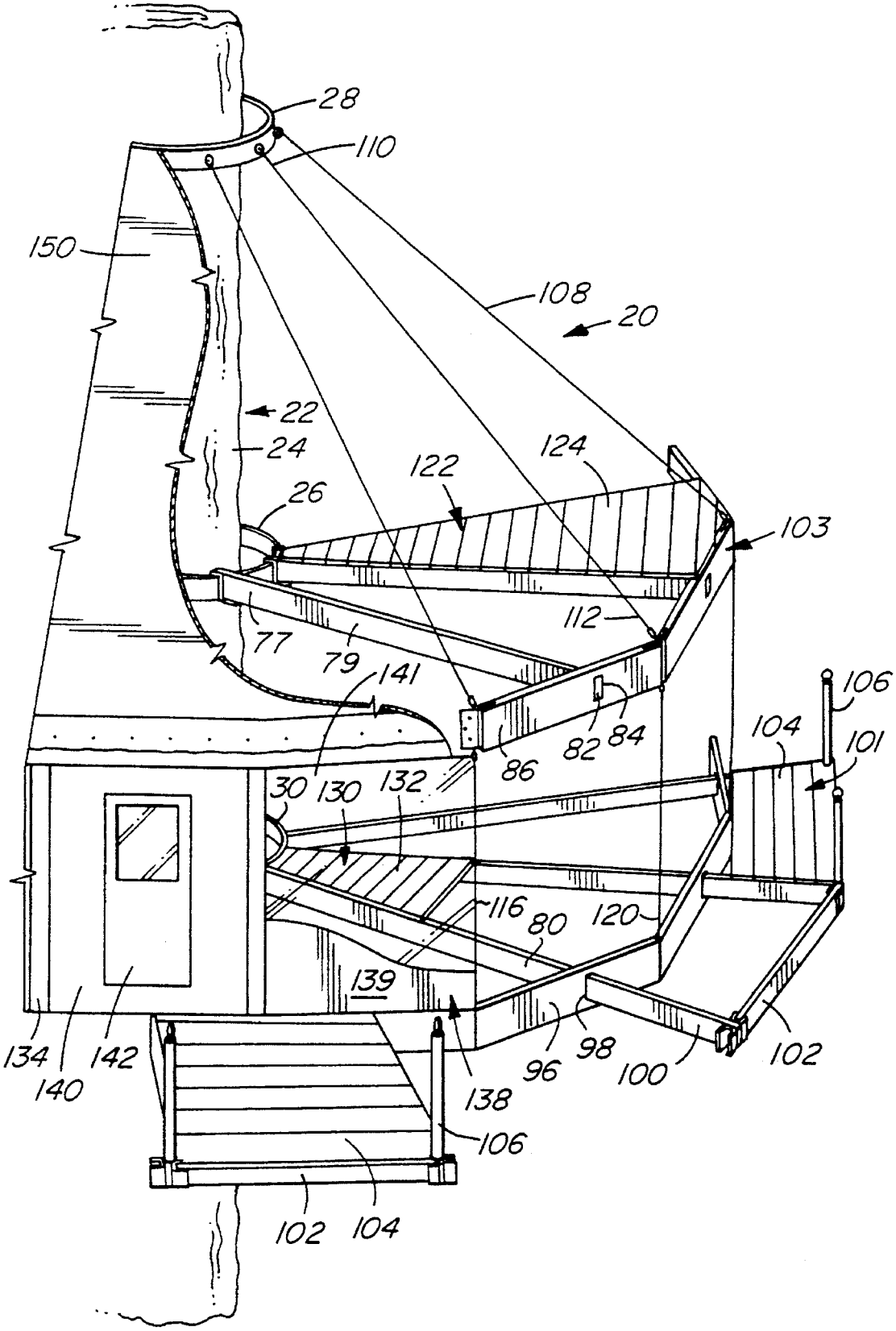
FIG. 1 is a fragmentary, isometric view, partly broken away, of a tree supported structure according to an embodiment of the invention.
Figure 9:
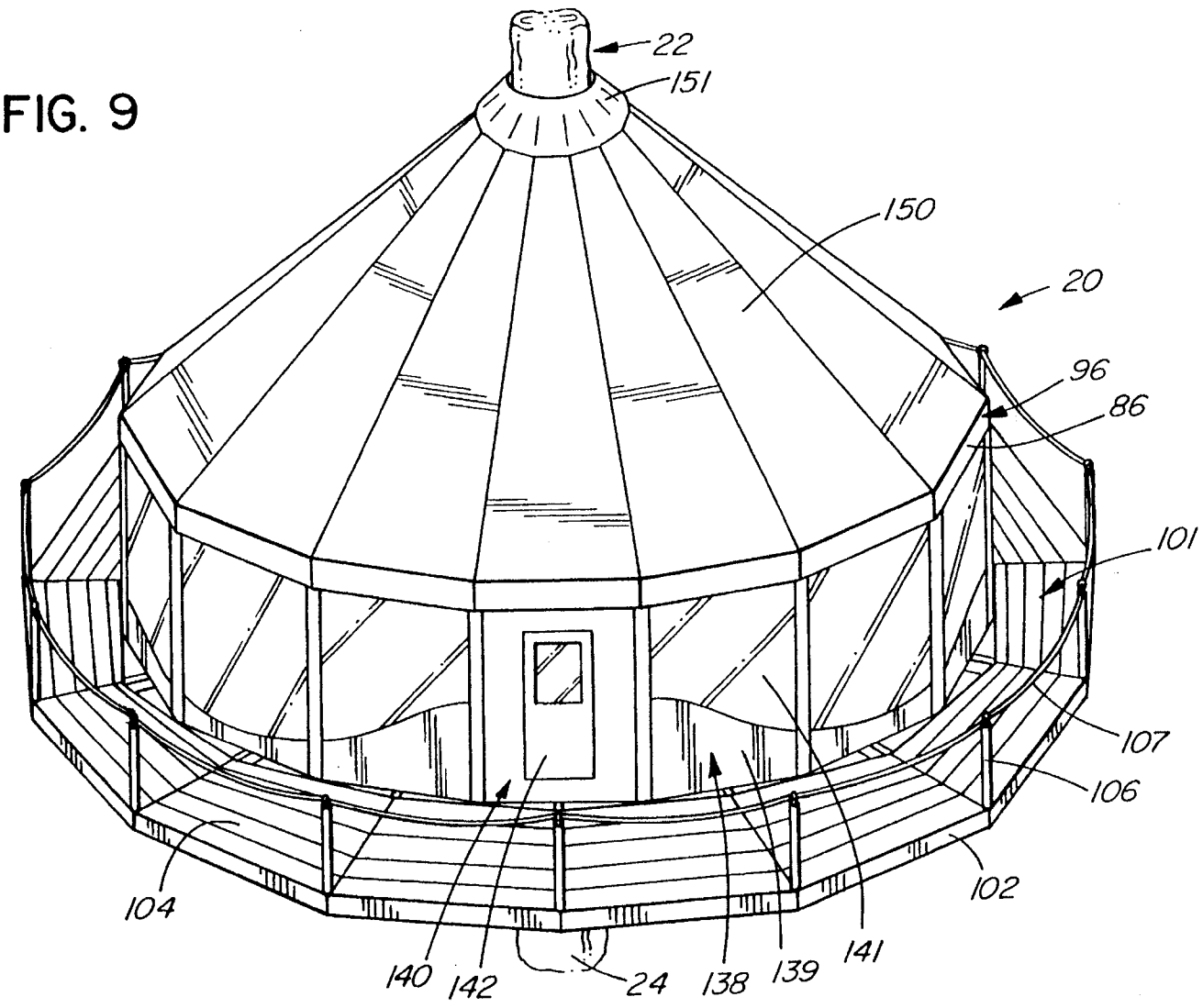
FIG. 9 is an isometric view of the structure of FIG. 1.

Referring first to FIG. 1 and 9, these show structure 20 adapted to be supported by a tree 22 having a trunk 24. The structure includes a first annular member 26, a second annular member 28 and a third annular member 30, all of which extend about the trunk of the tree and are vertically spaced-apart as seen in FIG. 1. The annular members are not tight against the tree in this example, but rather outwardly spaced-apart therefrom. These members are generally similar. They can be understood better with reference to FIG. 2 which shows member 28. Each of the annular members has a plurality of inwardly pointed members 32 which are spaced-apart thereabout. A plurality of mounts 34 are spaced-apart about inside 36 of the annular member. In this embodiment the annular member, the mounts and the inwardly pointed members are of steel. The mounts are rigidly connected to the annular member by welding in this example although other rigid connecting means could be employed.

Each of the mounts 34 has a slot 38 which extends through the mount from top 40 to inner end 42. The members are slidably received in the slots so as to be angled inwardly and downwardly with respect to the annular member. The inwardly pointed members have points 44 which in normal use are below the annular member.

Each mount has means for securing the pointed members in position in the slot. In this particular example the means includes a bolt 46 and a nut 48 extending through an aperture 50 in the mount and one of a plurality of apertures spaced-apart along each of the pointed members.

Figure 2:
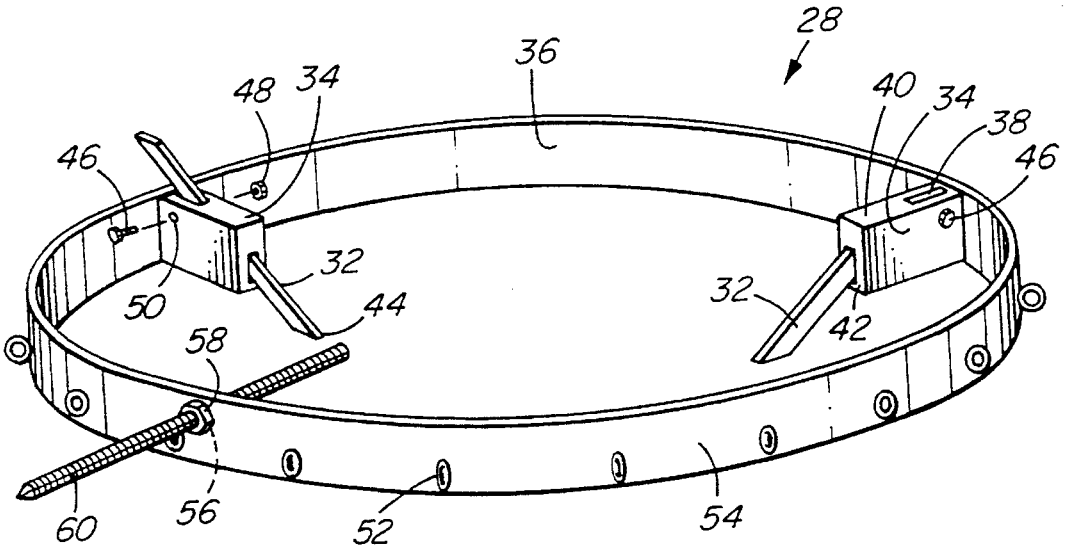
FIG. 2 is an isometric view of one of the tree embracing, annular members thereof.

FIG. 2 shows only two mounts and two pointed members, but annular member 28 actually has eight mounts 34 and the corresponding number of pointed members as seen in FIG.

Figure 3:
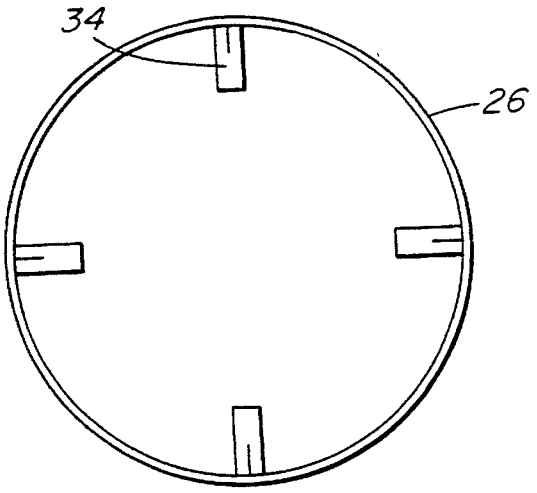
FIG. 3 is a top plan view of one of the annular members.
Figure 4:
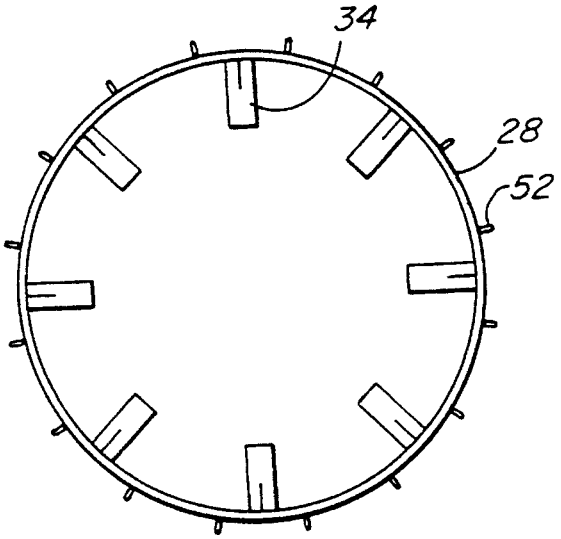
FIG. 4 is a top plan view of another annular member.

4. FIG. 3 shows mount 26 which has four mounts and pointed members in this embodiment like member 30. However the exact number of mounts and pointed members varies according to circumstances like the weight of the structure to be supported by the tree. Member 28 also differs from the other two members in that it includes a plurality of spaced-apart eyes 52 connected to outside 54 thereof which serve to connect cables to the member as described below.

Each annular member has a plurality of apertures 56 spaced-apart thereabout. Each of these apertures has a female thread. In the present embodiment this is accomplished by welding a nut 58 to the annular member. A male threaded rod 60 is received in each of the apertures 58. Although only one such rod and one such threaded aperture is shown in FIG. 2 there are at least three such apertures and rods for each annular member used for initial mounting only.

Figure 5:
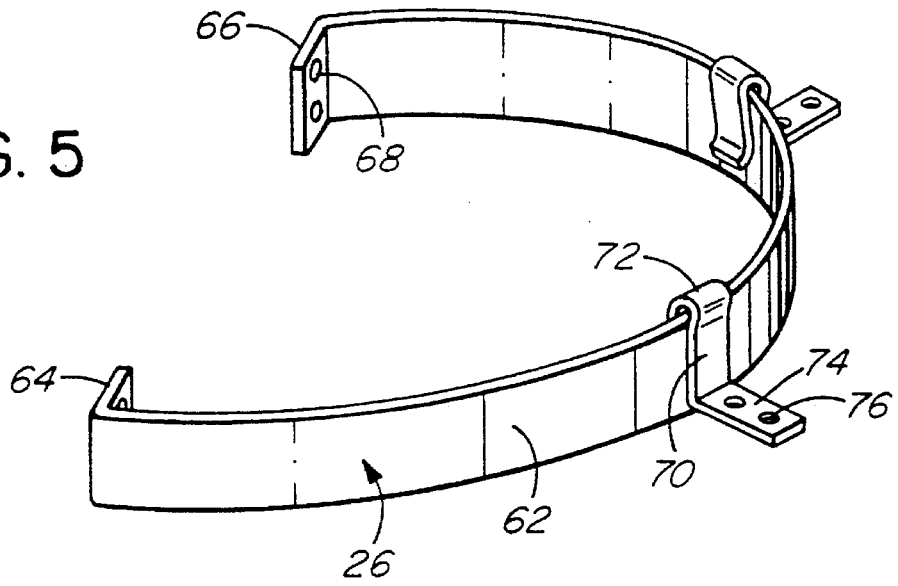
FIG. 5 is an isometric view of one segment of one of the annular members with brackets connected thereto.

Each annular member can be broken down into segments in order to place the member about a tree. In this particular example each annular member has two identical segments 62 having inwardly directed flanges 64 and 66 on opposite side thereof as seen in FIG. 5. Each of these flanges has apertures 68 which permit the segments to be bolted together to form the complete annular member. Two of the segments 62 are thus connected together about the tree to form each annular member. The annular members can be initially held in position about the tree by threading the rods 60 inwardly against the trunk until the annular member is evenly spaced about the trunk of the tree. Pointed members 32 are then inserted slidably through the slots 38 of the mounts 34 and are driven into the tree trunk using a hammer or mallet. The bolts 46 are then inserted through the apertures 50 and the corresponding apertures in the pointed members and held in place by the nuts 48. The pointed members are then rigidly connected to the annular member. It will be noted that the weight of the structure acting downwardly on each of the annular members tends to drive the pointed members 32 downwardly and inwardly with respect to the tree trunk, thus ensuring that the structure cannot slip down the tree. The pointed members actually cannot be forced further into the tree but the tree is free to grow outwardly as far as the annular member about the pointed members.

Figure 6:
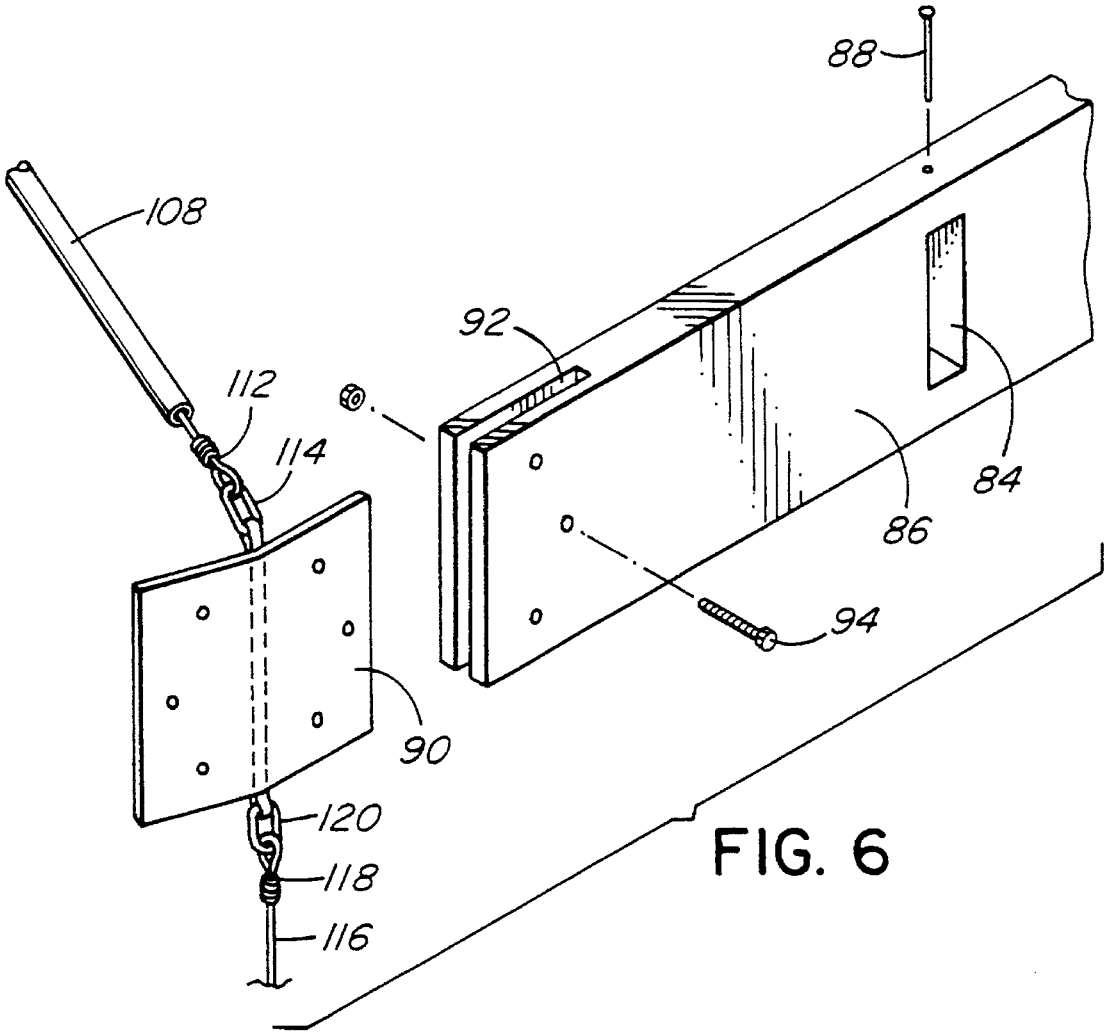
FIG. 6 is a fragmentary, isometric view showing portions of two of the tension cables thereof, a portion of one of the outer members of the platform and the bracket for connecting the cables to the outer members.
Figure 7:
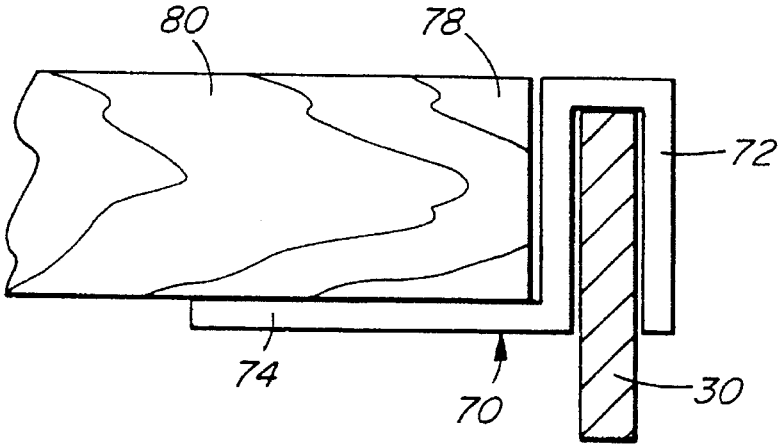
FIG. 7 is a fragmentary elevation showing one of the joists, the support bracket therefor and one of the annular members in section.

Annular member 26 as well as annular member 30 have a plurality of spaced-apart brackets 70 fitted thereto as seen in FIG. 5 and 7. The brackets are generally L-shaped having a hook portion 72 which fits over the annular member and a horizontal flange 74 which extends radially outwards therefrom. In this embodiment each of the flanges has a plurality of apertures 76 extending through the flange. The brackets 70 on annular member 26 serve as mounts for inner ends 77 of joists 79 shown in FIG. 1. The joists are also referred to herein as supports. Likewise brackets 70 of annular member 30 serve as supports for inner ends 78 of joists 80 as seen in FIG. 7. The joists extend radially outwards from the annular member 26 and have outer ends 82. The inner ends of the joists are secured by screws or other fasteners through apertures 76. The outer ends are connected perpendicularly to an outer member 86, forming a T-shaped frame. In this particular example the connection is achieved by fitting the outer end of each joist through a corresponding aperture 84 in the outer member. In this particular example the joists are 2×6 timber and the outer members 86 are 2×10 timber members. Bolts 88, shown in FIG. 6, secure the outer ends of the joists within apertures 84.

Adjacent outer members 86 are connected together by bracket plates 90 shown in FIG. 6. There is a central, vertical slot 92 at each end of each of the outer members. One end of each bracket plate 90 fits within one of the slots 92 and is secured in place by a plurality of bolts 94. The bracket plates 90 are slightly bent about the vertical center line in order to fit within the slots 92 of adjacent outer members. When all of the outer members are assembled using the bracket plates, they form a ring 96, shown in FIG. 9.

Joists 80 are generally similar to joists 79 and therefore are only described briefly. They extend through outer members 96 which are the same as outer members 86, having apertures 98 similar to apertures 84. However in this case the joists 80 are longer than joists 79 and extend outwardly beyond the outer members as seen in FIG. 1. Outer ends 100 of the joists are connected together by members 102. Floor boards 104 are connected to the joists to form a walkway 101 about the structure. There is a plurality of vertical posts 106 serving to support a railing 107 about the walkway as seen in FIG. 9. In this example the railing is of flexible rope, preferably poly rope. Netting should be fitted between the rope and the platform below.

Figure 8:
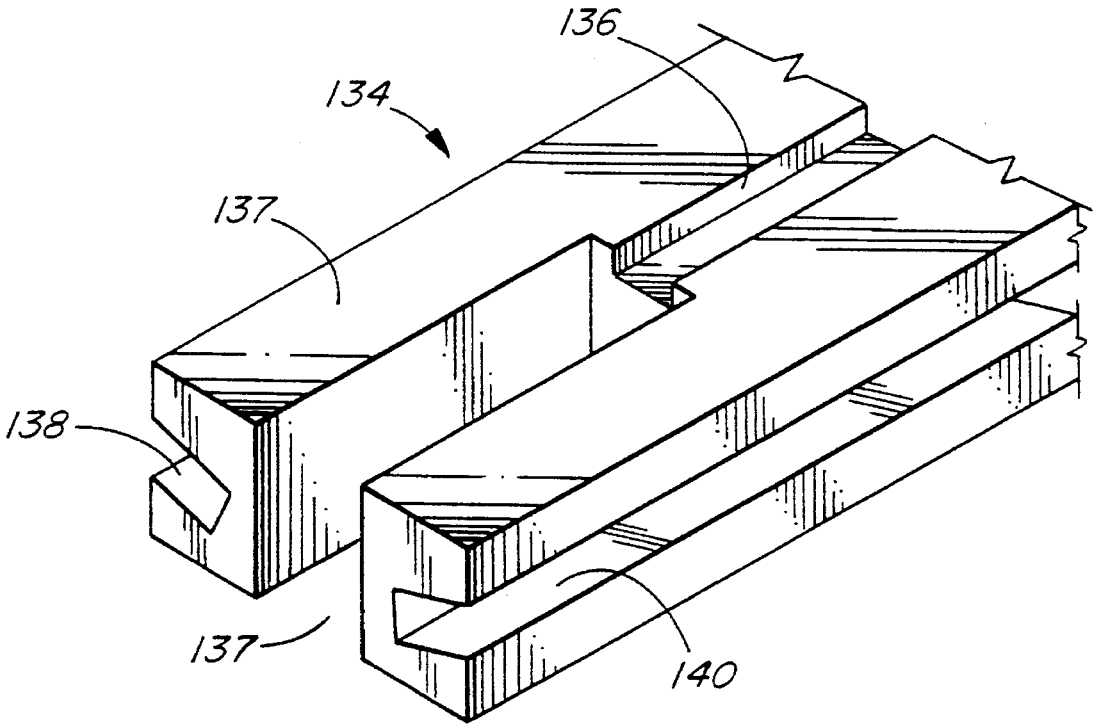
FIG. 8 is a fragmentary isometric view of one of the wall supports.

A plurality of first tension members, in this case cables 108, are spaced-apart about the structure as seen in FIG. 1 and 8. Each cable has a top end 110 connected to one of the eyes 52 of annular member 28. Each of the first cables has a bottom 112 connected to an eye 114 on one of the bracket plates 90. There are also second cables 116, one for each of the first cables 108. Each cable 116 has a top end 118 connected to an eye 120 on the bottom of each of the bracket plates. Each cable 116 has a bottom end 120 connected to one of the outer members 96 by means of a similar eye on the bracket plates (not shown) connecting the members 96 together which are identical to bracket plates 90 in this example.

There is a first platform 122 formed by floor boards 124 connected to the tops of the joists 79, in this case by screws. A similar second platform 130 is formed on the tops of joists 80 by a plurality of floor boards 132. Thus the structure has a first floor formed by platform 130 and a second floor formed by a platform 122.

Outer walls of the structure are connected between the outer members 86 and 96. In this particular example the outer walls are supported by grooved boards 134 as shown in FIG. 1 and FIG. 8. Each board has a vertical slot 136 extending along inner side 137 thereof for receiving one of the cables 116. Slots 137 receive the eyes of the bracket plates and cable fittings. Grooves 138 and 140 at each end of the panel receive panels fitted within the spaces between boards 134. For example, these may be panels 138 with solid bottoms 139 and transparent windows on top, preferably of acrylic plastic, or a panel 140 with a door 142 as shown in FIG. 1.

This particular structure has a roof 150 shown in FIG. 1 and FIG. 9. The roof is generally conical and fits over the cables 108 extending between the annular member 28 and ring 103 formed by outer members 86. In this example the roof is of waterproof fabric. A skirt 151, of neoprene in this example, fills the space between the rest of the roof and the tree trunk as shown in FIG. 9. This can be opened for ventilation.

The disclosure describes the basic tree supported structure 20. Additional features can be added such as ladders or stairs between the platform 130 and the platform 122. Also a ladder, preferably retractable, can be built to extend downwardly from the walkway to the ground. Many variations of the structure are possible including additional floors, variation in the dimensions, sizes and numbers of components and adding additional features customary for dwellings such as electrical wiring, plumbing and heating equipment. Also the roof can be made of rigid panels instead of fabric as in this embodiment. A single annular member can be used to support a simple platform for use as an observation point or the like. Generally the structure is intended for occasional, recreational use although it could be modified for permanent residence.

It will be understood by someone skilled in the art that many of the details described above are by way of example only and are not intended to limit the scope of the invention which is to be interpreted with reference to the following claims.

What is claimed is:

1. A tree supported structure, comprising:

a first annular member having a plurality of inwardly pointed members, the annular member having a top and a bottom, the pointed members being angled downwardly and extending below the bottom of the annular member, and a plurality of radially inwardly extending mounts connected thereto, each said mount having a said slot receiving one said pointed member and means for securing said each pointed member in position in the slot.

2. A structure as claimed in claim 1, wherein said means includes a threaded fastener.

3. A structure as claimed in claim 1, wherein the annular member has means for locating said annular member in position about the tree.

4. A structure as claimed in claim 3, wherein the means for locating includes a plurality of elongated male threaded members and female threaded apertures in the annular member receiving the male threaded members, the male threaded members extending radially with respect to the annular member.

5. A structure as claimed in claim 1, including a second said annular member with a plurality of inwardly pointed members, the second member being above the first annular member and having a plurality of first tension members with top ends connected to the second annular member and bottom ends connected to the platform.

6. A tree supported structure, comprising: a first annular member having a plurality of inwardly pointed members; outwardly extending first supports mounted on the annular member; a first platform connected to said supports; and a second annular member with a plurality of inwardly pointed members, the second member being above the first annular member and having a plurality of first tension members with top ends connected to the second annular member and bottom ends connected to the platform.

7. A structure as claimed in claim 6, wherein the supports are angularly spaced-apart and extend radially outwards from the first annular member.

8. A structure as claimed in claim 7, wherein the platform includes outer members connected perpendicularly to the supports, the outer members being connected together to form a ring which is spaced-apart radially outwards from the first annular member.

9. A structure as claimed in claim 8, wherein the outer members are connected together by bracket plates, the bottom ends of the tension members being connected to the bracket plates.

10. A structure as claimed in claim 6, the platform having an outside, the structure including a roof extending over the tension members between the second annular member and the outside of the platform.

11. A structure as claimed in claim 10, including a third annular member below the first annular member, the third annular member having a plurality of inwardly pointed members and outwardly directed second supports, and a second platform connected to said second supports.

12. A structure as claimed in claim 11, including a plurality of second tension members having tops connected to the first platform and bottoms connected to the second platform.

13. A structure as claimed in claim 12, wherein the second tension members are vertical, the structure including walls extending between the first and second platforms.

14. A tree structure, comprising:

a tree having a vertical trunk;

three vertically spaced-apart annular members extending about the trunk, each said annular member having an outside and a plurality of pointed members extending downwardly and inwardly into the trunk, a first said annular member being below a second said annular member and above a third said annular member, the outsides of the first and third annular members having a plurality of joist supports and the outside of the second annular member having a plurality of cable anchors;

a plurality of floor joists extending radially outwards from the first and third annular members, the joists having inner ends connected to the joist supports;

outer members connected perpendicularly to each said joist, the outer members being connected together to form first and second outer rings extending about the tree trunk radially outwards from the first and third annular members respectively;

two platforms mounted on the joists;

first cables having top ends connected the cable anchors of the second annular member and bottom ends connected to the first ring;

second cables having top ends connected to the first outer ring and bottom ends connected to the second outer ring;

a roof extending over the first cables and between the second annular member and the first outer ring; and outer walls extending between the outer rings.

* * * * *